US010105570B1

(12) United States Patent
Carlisle et al.

(10) Patent No.: US 10,105,570 B1
(45) Date of Patent: Oct. 23, 2018

(54) NEVER TIRE™ EXERCISE APPARATUS

(71) Applicants: Randall Carlisle, Athens, LA (US); Robert E. Crook, II, Altoona, PA (US)

(72) Inventors: Randall Carlisle, Athens, LA (US); Robert E. Crook, II, Altoona, PA (US)

( * ) Notice: Subject to any disclaimer, the term of this patent is extended or adjusted under 35 U.S.C. 154(b) by 0 days.

(21) Appl. No.: 15/357,861

(22) Filed: Nov. 21, 2016

(51) Int. Cl.
*A63B 23/00* (2006.01)
*A63B 23/02* (2006.01)

(52) U.S. Cl.
CPC ..... *A63B 23/0211* (2013.01); *A63B 2225/62* (2013.01)

(58) Field of Classification Search
None
See application file for complete search history.

(56) References Cited

U.S. PATENT DOCUMENTS 558,327 A * 4/1896 Tower ..... B62D 1/04 301/65
3,037,218 A * 6/1962 Brooks, III ..... B63C 9/02 244/905
3,558,135 A * 1/1971 Rees ..... A63B 69/345 273/DIG. 4
4,673,179 A * 6/1987 Pengler ..... A63B 21/072 482/139
5,149,390 A * 9/1992 Beard ..... B29D 30/24 156/414
6,648,707 B1 * 11/2003 Peterson ..... B63B 7/085 114/345
8,672,813 B2 * 3/2014 West ..... A63B 5/11 482/23
D751,655 S * 3/2016 Januszek ..... D21/662
9,364,699 B2 * 6/2016 Gordon ..... A63B 5/11
D800,233 S * 10/2017 Januszek ..... D21/662
D802,063 S * 11/2017 Nelson ..... D21/680
D806,185 S * 12/2017 Ross ..... D21/662
2007/0117658 A1 * 5/2007 Best ..... A63B 69/004 473/415
2012/0208678 A1 * 8/2012 Knilans ..... A63B 23/0458 482/52
2015/0165258 A1 * 6/2015 Januszek ..... A63B 21/06 482/93
2016/0136473 A1 * 5/2016 Chen ..... A63B 5/11 482/29

* cited by examiner

*Primary Examiner* — Stephen R Crow
(74) *Attorney, Agent, or Firm* — Richard K Thomson

(57) ABSTRACT

A tire-like exercise device having a substantially round outer periphery and a non-round inner periphery. The non-round inner periphery may be substantially rectangular and have one or more flat regions to provide hand and toe holds for performing various exercises. A first valve allows the firmness of the Never Tire™ exercise apparatus to be adjusted by increasing or decreasing inner air pressure. A second larger valve allows ballast, such as water or sand, to be input to the device to stabilize the apparatus against slipping and sliding.

4 Claims, 4 Drawing Sheets

NEVER TIRE™ EXERCISE APPARATUS

BACKGROUND AND SUMMARY OF THE INVENTION

The present invention relates to the field of sporting goods. More particularly, the present invention is directed to an inflatable exercise apparatus useful in developing stamina.

The exercise apparatus identified as "Never Tire™", is gaining national recognition as a result of the success of the teams the inventor coaches. The inventor's utilization of the apparatus in developing stamina of these young men and women gives them a decided advantage over the teams they play and, when utilized in conjunction with other training tools such as the Ultimate Defender™ training aid (described and claimed in U.S. Pat. No. 7,658,689), has allowed both the boys and girls the inventor coaches to win state championships in the same year. While NEVER TIRE™ exercise apparatus has been especially useful in developing stamina in basketball players, it has equal applicability in strengthening participants in other sports including but not limited to baseball, football, track, soccer, ice and field hockey, swimming, cross-country running and skiing.

NEVER TIRE™ exercise apparatus comprises an inflatable tire-like device utilized to maximize the trainee's stamina such that the individuals "never tire" enabling the team to "put a whuppin'" on the opponent. The tire-like device is made from materials selected from soft PVC and other vinyl-like plastic materials and has a generally round outer periphery with a non-round inner periphery. The non-round inner periphery is preferably formed with at substantially rectangular configuration that has at least one and, more preferably, a plurality of flat regions which provide hand and footholds for the trainee. NEVER TIRE™ exercise apparatus is preferably equipped with two fill valves, one for admitting air and the other for water, sand, or similar ballast materials.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
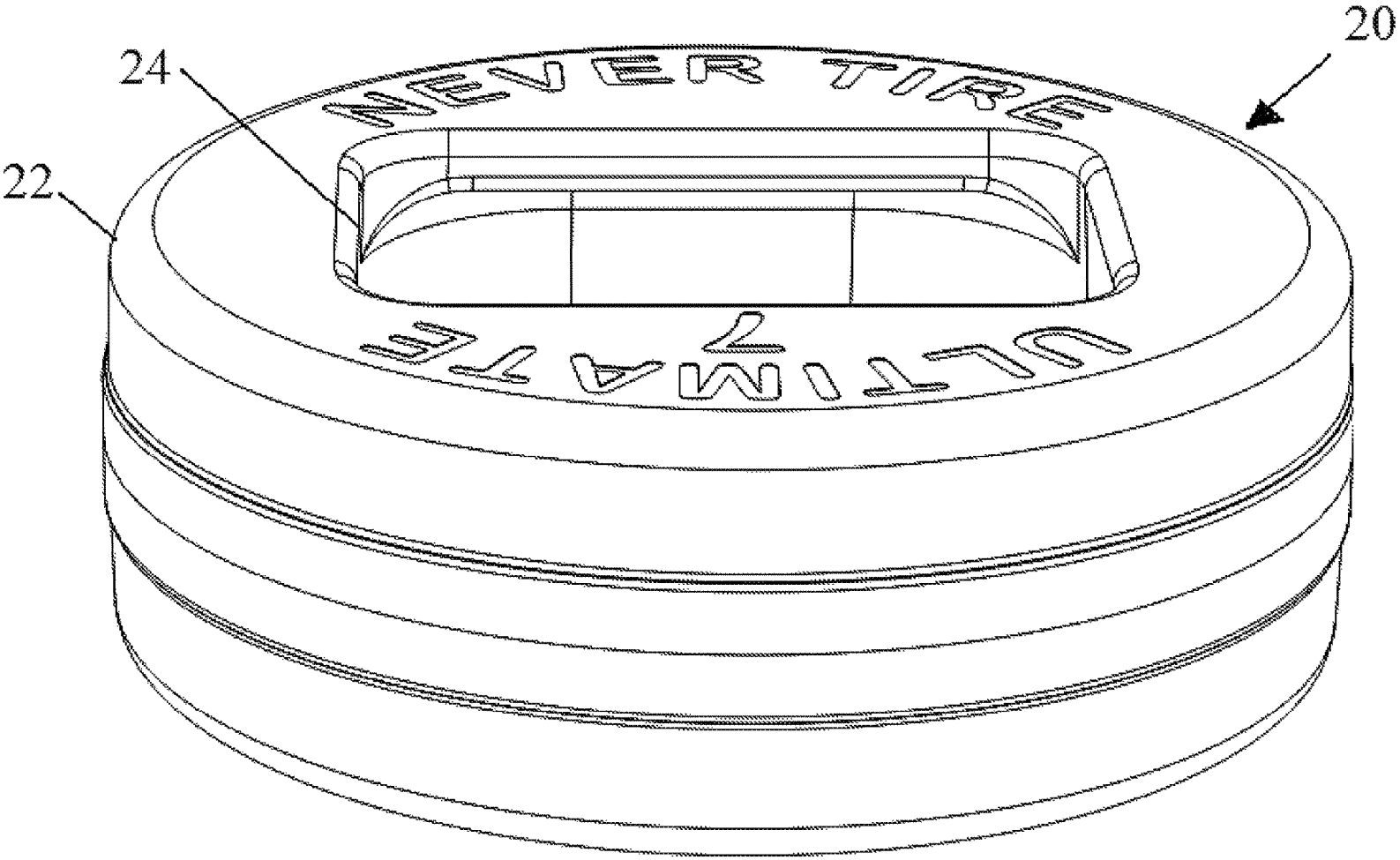
FIG. 1 is a top perspective view of a first embodiment of the Never Tire™ exercise apparatus of the present invention.
Figure 2:
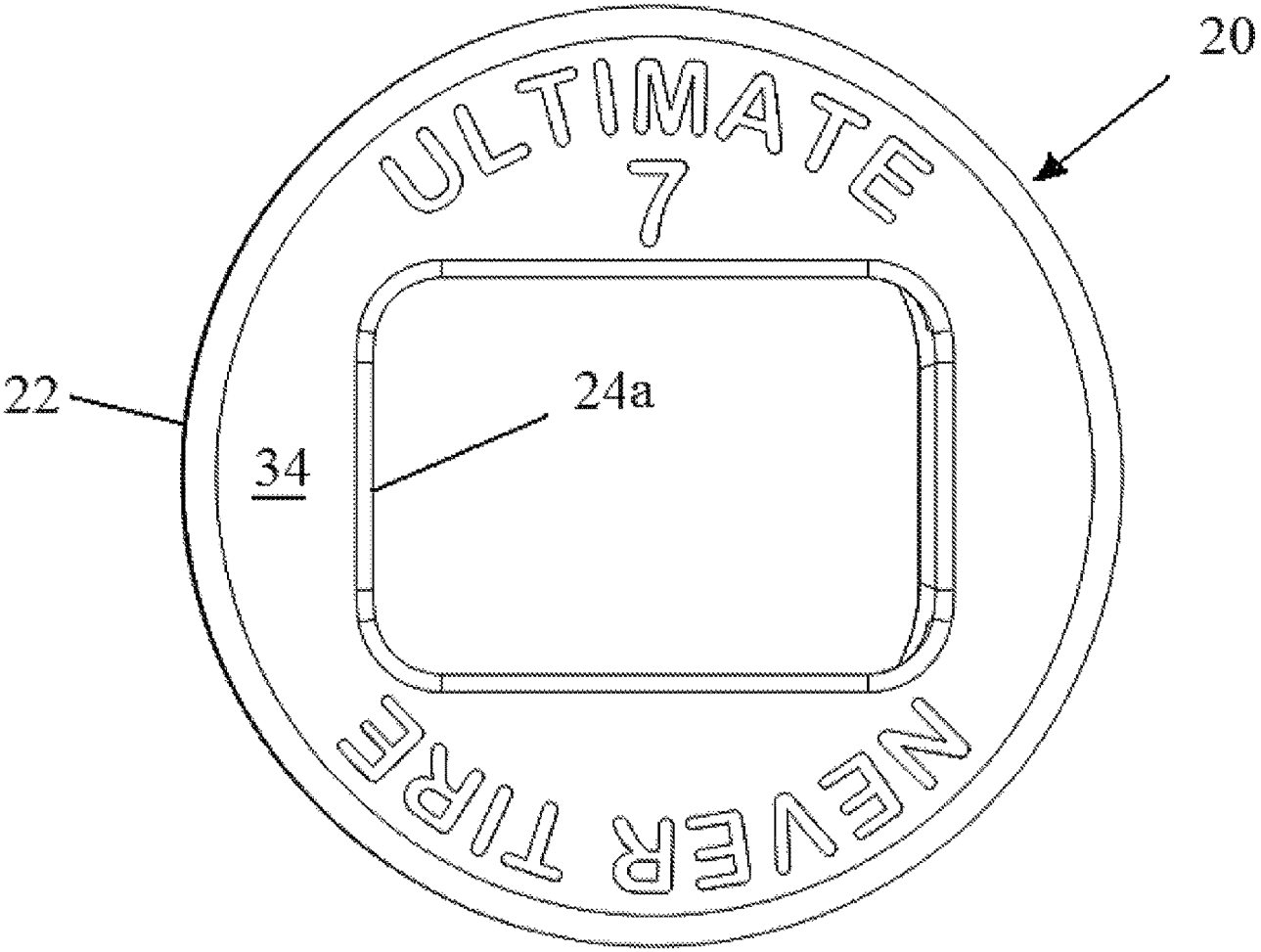
FIG. 2 is a front view of the first embodiment.
Figure 3:
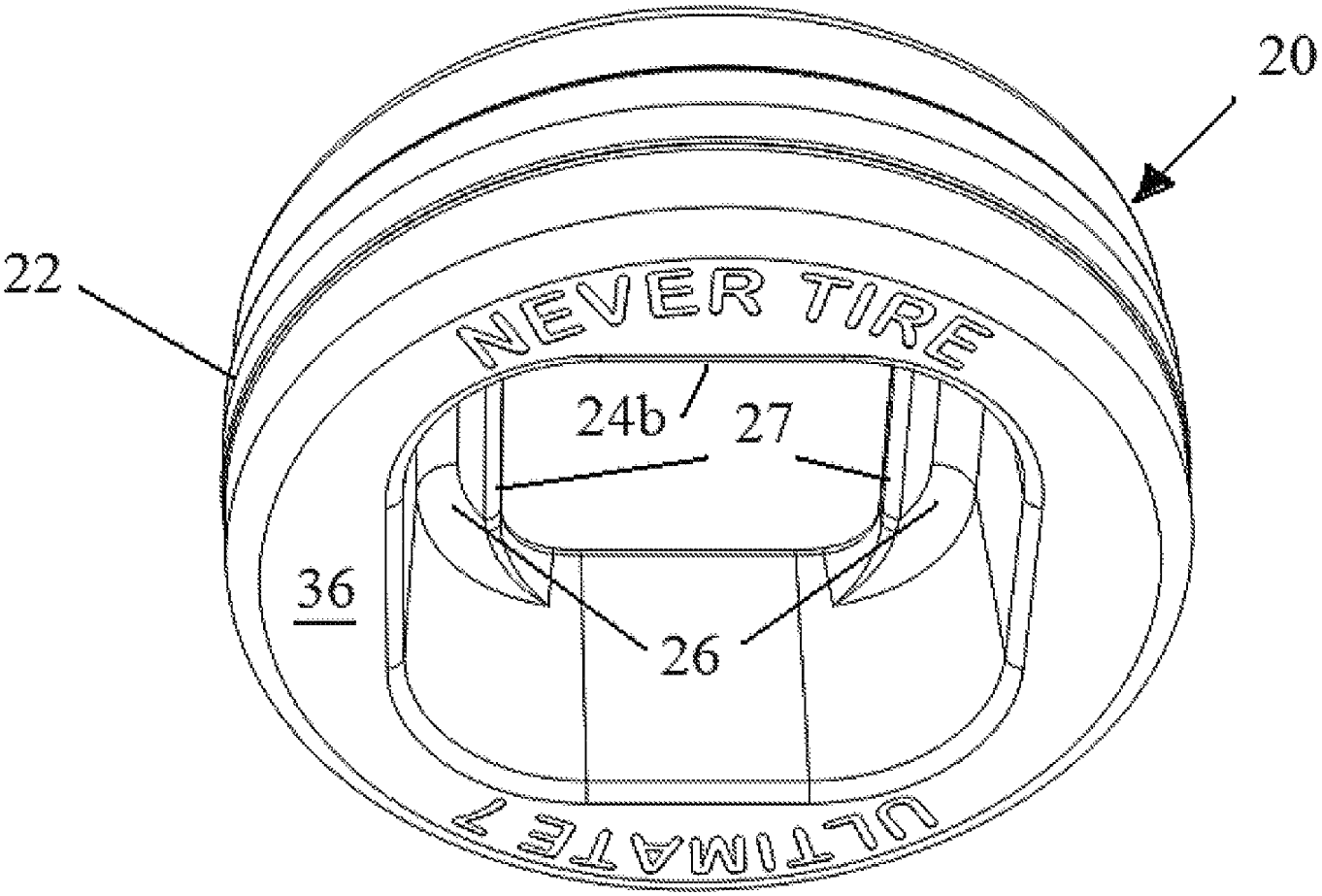
FIG. 3 is a bottom perspective view of the first embodiment.

A first embodiment of the Never Tire™ exercise apparatus of the present invention is depicted in FIGS. 1-4 generally at 20. Never Tire™ exercise apparatus 20 is a tire-like device having a substantially circular (round) outer periphery 22 and a non-round inner periphery. As seen in FIG. 3, on the bottom 36 of the device 20, the inner periphery 24*b* is substantially square. From the top 34 of the apparatus 20, the inner periphery appears substantially rectangular. This is the result of two flattened regions 26 that provide hand and foot holds for performing various exercises. Preferably, these hand/footholds have a slight lip or overhang 27 that facilitate gripping of regions 26. By engaging ones toes under overhang 27, sit-ups or other ab exercises may more easily be performed than say, with a conventional inner tube or truck tire.

Figure 4:
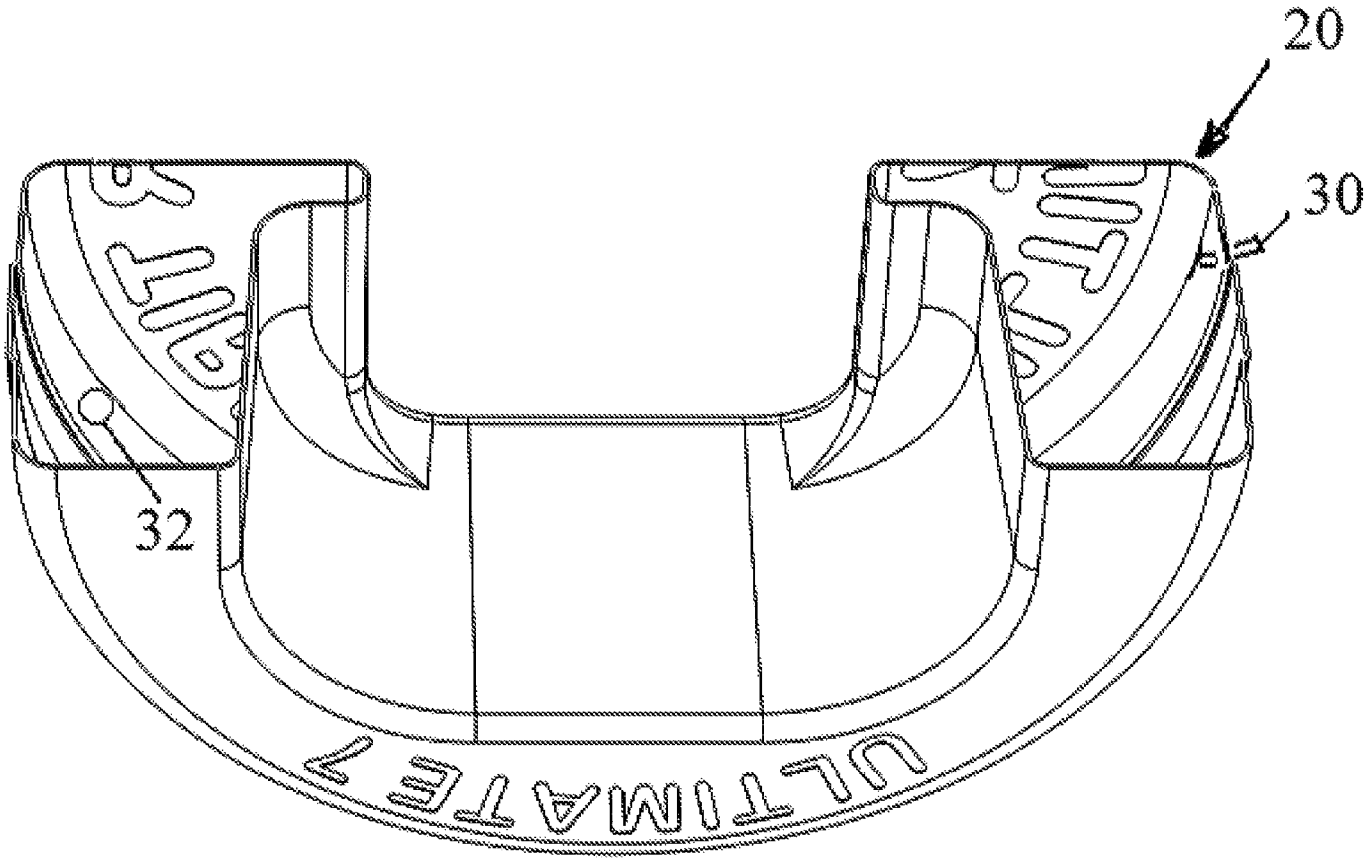
FIG. 4 a cross-sectional bottom perspective view of the first embodiment.

The cross-section shown in FIG. 4 depicts Never Tire™ exercise apparatus 20 as a thin-walled inflatable bladder which is preferably formed of soft PVC or other vinyl-like plastic materials. A first conventional valve has an external stem 30 that permits air to be added to or taken from the interior of the apparatus 20 to adjust the firmness of the device. A second larger diameter valve 32 permits water, sand, or other ballast material to be added to or taken from the interior. Such ballast will provide stability to the Never Tire exercise apparatus reducing the tendency to slip or slide as the participant works out on the device 20.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

We claim:

1. An inflatable tire-like exercise device, said device comprising:

a first element formed as an expandable bladder having a first substantially round outer periphery and a second non-round inner periphery of said same first element wherein a portion of said non-round inner periphery is substantially rectangular.

2. The exercise device of claim 1 wherein said non-round inner periphery includes substantially flat regions formed by undercut recesses providing hand and toe grips for performing various exercises.

3. The exercise device of claim 1 further comprising a first valve for adding and removing air to adjust a firmness of said device.

4. The exercise device of claim 3 further comprising a second valve for adding and removing ballast material.

* * * * *